US007673971B2

(12) United States Patent
Timm et al.

(10) Patent No.: US 7,673,971 B2
(45) Date of Patent: Mar. 9, 2010

(54) FLUID EJECTION DEVICE AND MANUFACTURING METHOD

(75) Inventors: Dale D. Timm, Solana Beach, CA (US); Hai Quang Tran, San Diego, CA (US); Joseph E. Scheffelin, Poway, CA (US); Larry E. Schnebly, Corvallis, OR (US); Paul Schweitzer, Corvallis, OR (US); Jim Fischer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 324 days.

(21) Appl. No.: 11/810,145

(22) Filed: Jun. 5, 2007

(65) Prior Publication Data

US 2007/0236538 A1 Oct. 11, 2007

Related U.S. Application Data

(62) Division of application No. 10/796,720, filed on Mar. 9, 2004, now Pat. No. 7,240,991.

(51) Int. Cl.
*B41J 2/14* (2006.01)
*B41J 2/16* (2006.01)

(52) U.S. Cl. ..... 347/50; 347/71; 347/86

(58) Field of Classification Search ..... 347/50
See application file for complete search history.

(56) References Cited

U.S. PATENT DOCUMENTS

| | | | | |
|---|---|---|---|---|
| 5,734,394 | A * | 3/1998 | Hackleman | 347/42 |
| 6,705,705 | B2 | 3/2004 | Horvath et al. | |
| 2003/0007034 | A1 * | 1/2003 | Horvath et al. | 347/50 |
| 2004/0075716 | A1 * | 4/2004 | Shin et al. | 347/56 |

* cited by examiner

*Primary Examiner*—Matthew Luu
*Assistant Examiner*—Brian J Goldberg

(57) ABSTRACT

An ink cartridge for an ink jet printer includes a substratum and a cover attached to the substratum and having an aperture provided therein. A printhead is attached to the substratum and provided at least partially within the aperture. At least one connector extends from the printhead into the aperture, and an adhesive material covers at least a portion of the at least one connector. At least one barrier is provided for preventing the adhesive material from flowing to locations away from the at least one connector.

12 Claims, 8 Drawing Sheets

FLUID EJECTION DEVICE AND MANUFACTURING METHOD

CROSS-REFERENCE TO RELATED APPLICATIONS

This application is a Divisional of U.S. patent application Ser. No. 10/796,720, filed on Mar. 9, 2004 now U.S. Pat. No. 7,240,991, which is incorporated herein by reference.

BACKGROUND

Fluid ejection assemblies, such as ink jet printers, utilize fluid ejection devices, e.g., ink cartridges, to dispense fluid or ink, e.g., onto a recording or print medium such as paper. Such devices include a container having one or more chambers for storing liquid ink. The ink is dispensed by a printhead that includes a plurality of nozzles or orifices and that is provided adjacent the recording medium during operation of the printer.

In one arrangement, commonly referred to as a wide-array inkjet printing system, a plurality of individual printheads, also referred to as dies, are attached or connected to a single substratum. In other arrangements, only a single printhead may be provided. A printhead is electrically connected to the substratum such that signals may be provided by the printer to the printhead to selectively disperse fluid or ink as needed.

Wires used to electrically connect the one or more printheads to the substratum are relatively fragile, and are subject to breakage during manufacturing and/or use of the fluid ejection device. For example, the wires may be subject to damage during the regular cleaning cycle of the printheads during use, as when the cleaning mechanism brushes across the printhead surface.

It would therefore be advantageous to provide a fluid ejection device or cartridge (e.g., an ink cartridge, etc.) that utilizes wires to connect the one or more printheads to the substratum in a manner that reduces the damage to the wires.

It would also be advantageous to provide a material to encapsulate the wires without damaging the wires and/or the printheads. It would be desirable to provide a fluid ejection device and/or a method of making such a device that exhibits any one or more of these or other advantageous features.

DETAILED DESCRIPTION OF EXAMPLE EMBODIMENTS

Figure 1:
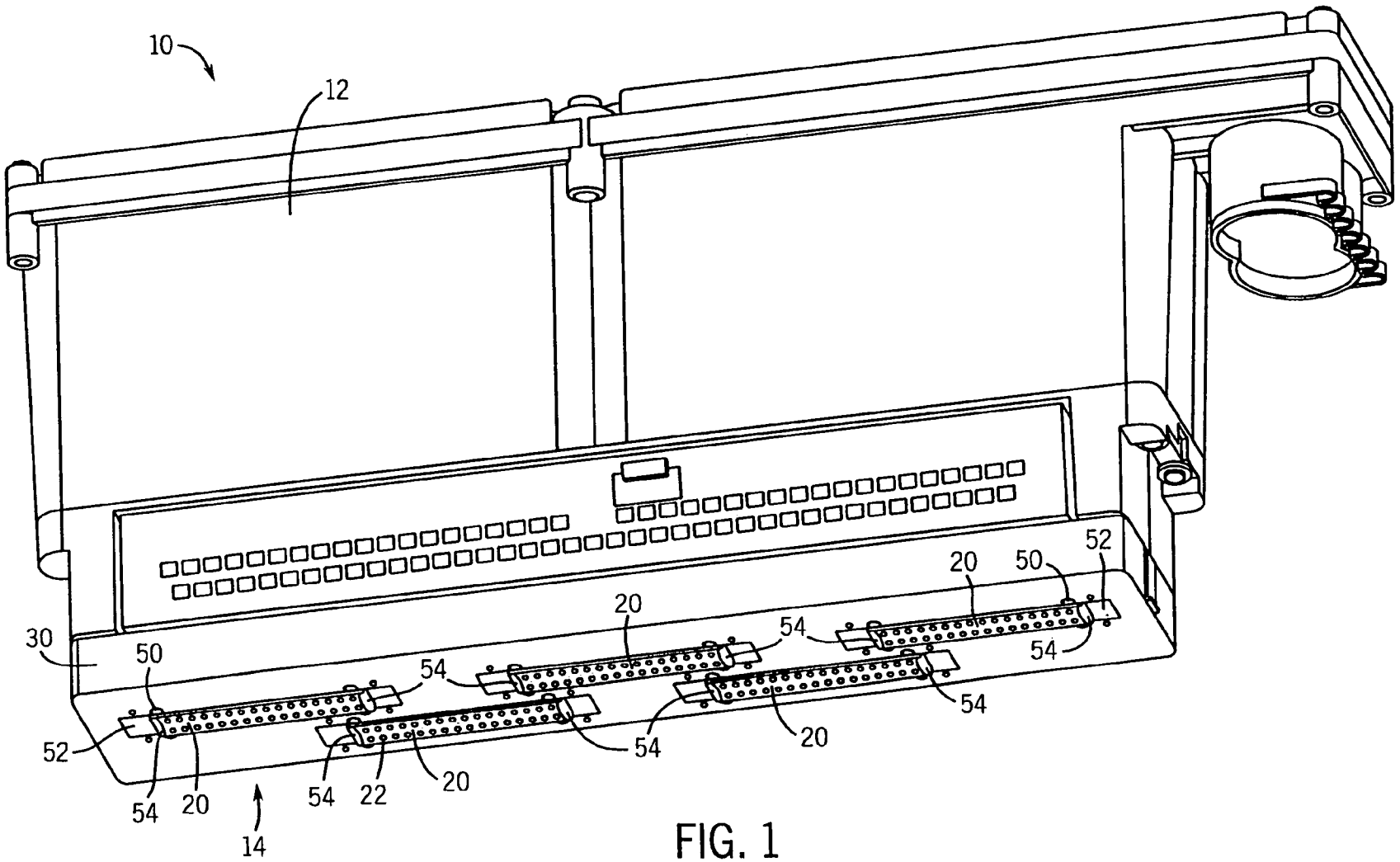
FIG. 1 is a perspective view of a fluid ejection device according to an example embodiment.

FIG. 1 shows a perspective view of a fluid ejection device or cartridge 10 shown as an ink or printer cartridge. According to an example embodiment, fluid ejection device 10 is intended for use as an ink cartridge for an ink jet printer (e.g., a thermal ink jet or bubble jet printer). Fluid ejection device 10 includes a container 12 for storing ink to be ejected onto a printing medium (e.g., paper, etc.).

Figure 2:
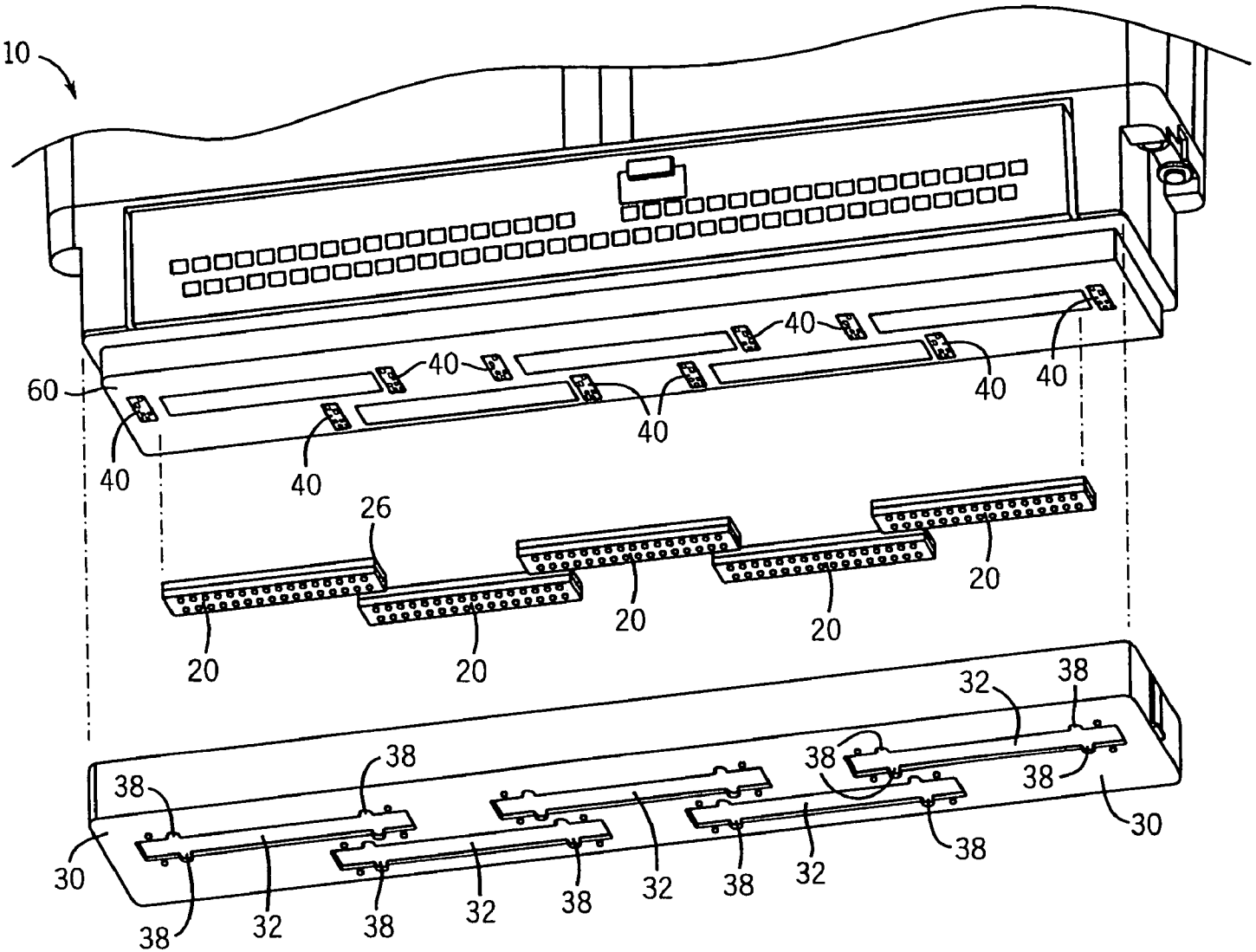
FIG. 2 is an exploded perspective view of a portion of the fluid ejection device shown as an example embodiment in FIG. 1.

A bottom or lower portion 14 of fluid ejection device 10 includes one or more printheads or dies 20. As shown in FIG. 2, each of printheads 20 is attached or coupled (e.g., using an adhesive or other means) to a substratum or structure 60 that includes a plurality of electrical contacts or pads 40 provided thereon. Contacts 40 provided on substratum 60 are intended to provide an electrical connection or interface between printheads 20 and the electronics provided as part of fluid ejection device 10. In this manner, substratum 60 may act as a circuit board, and may be manufactured according to any acceptable known method for producing circuit boards.

According to the example embodiment shown in FIG. 1, fluid ejection device 10 includes five printheads 20. According to other example embodiments, fluid ejection device 10 may include a different number of printheads (e.g., 4 or fewer printheads or greater than 5 printheads). It should also be noted that while printheads 20 shown in FIG. 1 are arranged in a staggered or offset arrangement, any suitable arrangement, in terms of positioning and alignment, for the one or more printheads may be used according to other embodiments.

According to an example embodiment, each printhead 20 is approximately one inch in length by approximately 0.017 inches (0.432 mm) in width and approximately 0.027 inches (0.658 mm) thick. According to other exemplary embodiments, the printhead may have a thickness of up to approximately 0.040 inches (1.0 mm). According to various other embodiments, other dimensions for the printheads may be utilized depending on various considerations, including the dimensions of the fluid ejection device, the number of nozzles required for a particular application, the manufacturability of such printheads, and any of a variety of other considerations.

Each printhead 20 includes a plurality of nozzles or apertures 22 for ejecting ink from fluid ejection device 10 onto a printing medium. According to an example embodiment, each printhead 20 includes more than 1,000 nozzles (e.g., 2,000 nozzles or more, etc.). While the schematic representation shown in FIG. 1 shows two parallel rows of nozzles, such layout should not be interpreted as limiting. Any number of nozzles may be provided, in any of a wide variety of layouts.

A cover or shroud 30 (e.g., a cap shroud) is also attached to substratum 60 at bottom portion 14 of fluid ejection device 10. Cover 30 includes a plurality of apertures 32 (see, e.g., FIG. 2) in which at least a portion of printheads 20 are positioned when cover 30 and printheads 20 are coupled to substratum 60. According to an example embodiment, apertures 32 have a size and shape configured such that a gap exists around the perimeter of printheads 20 when printheads 20 are provided in the apertures 32. That is, a gap or space is provided above substratum 60 and between walls or sides 28 of printheads 20 and walls 33 of apertures 32. In this manner, printheads 20 are spaced apart from cover 30 when cover 30 is coupled to substratum 60.

Figure 3:
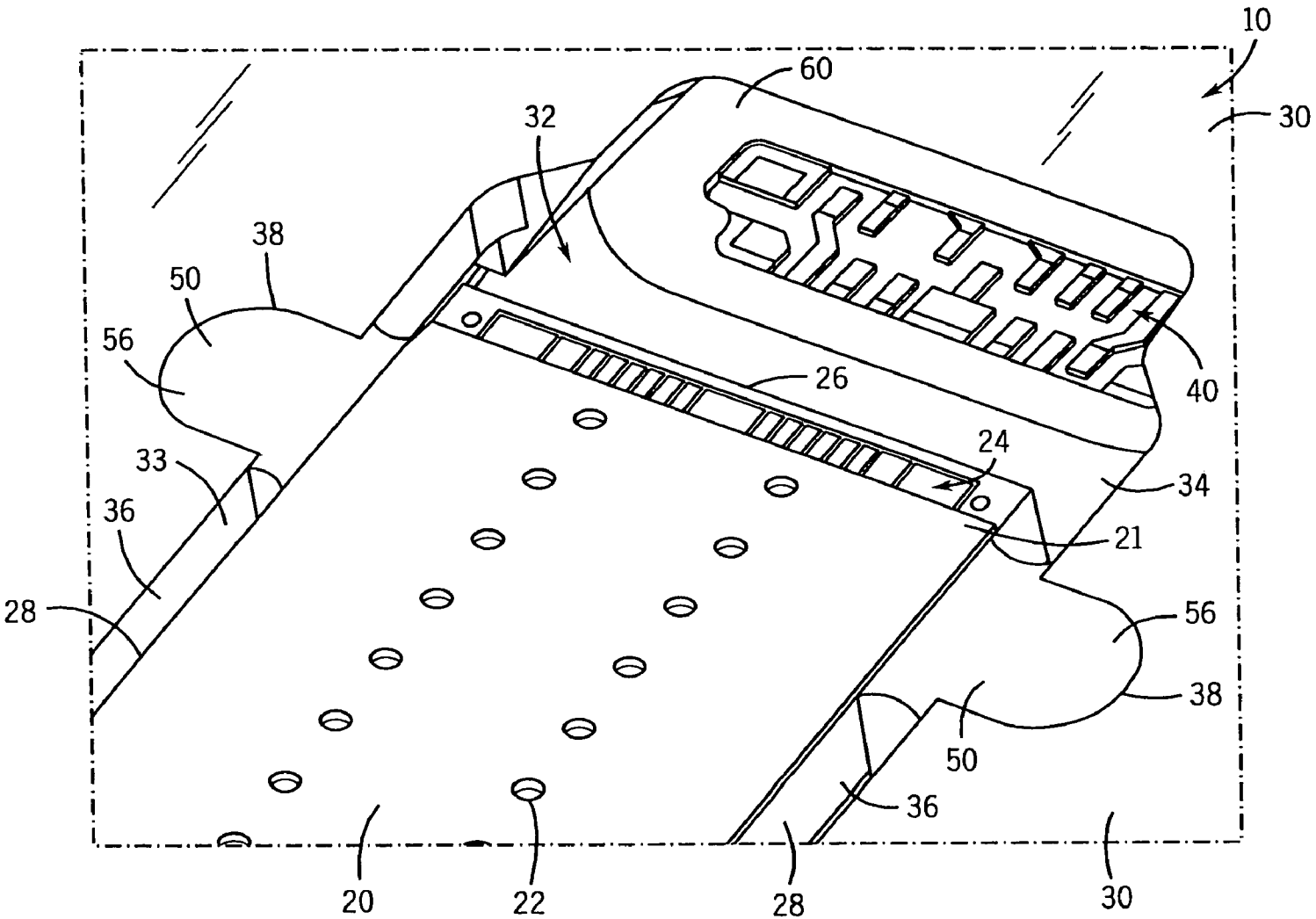
FIG. 3 is a perspective view of a portion of the fluid ejection device shown as an example embodiment in FIG. 1 showing a printhead provided in an aperture formed in a cover or shroud.
Figure 4:
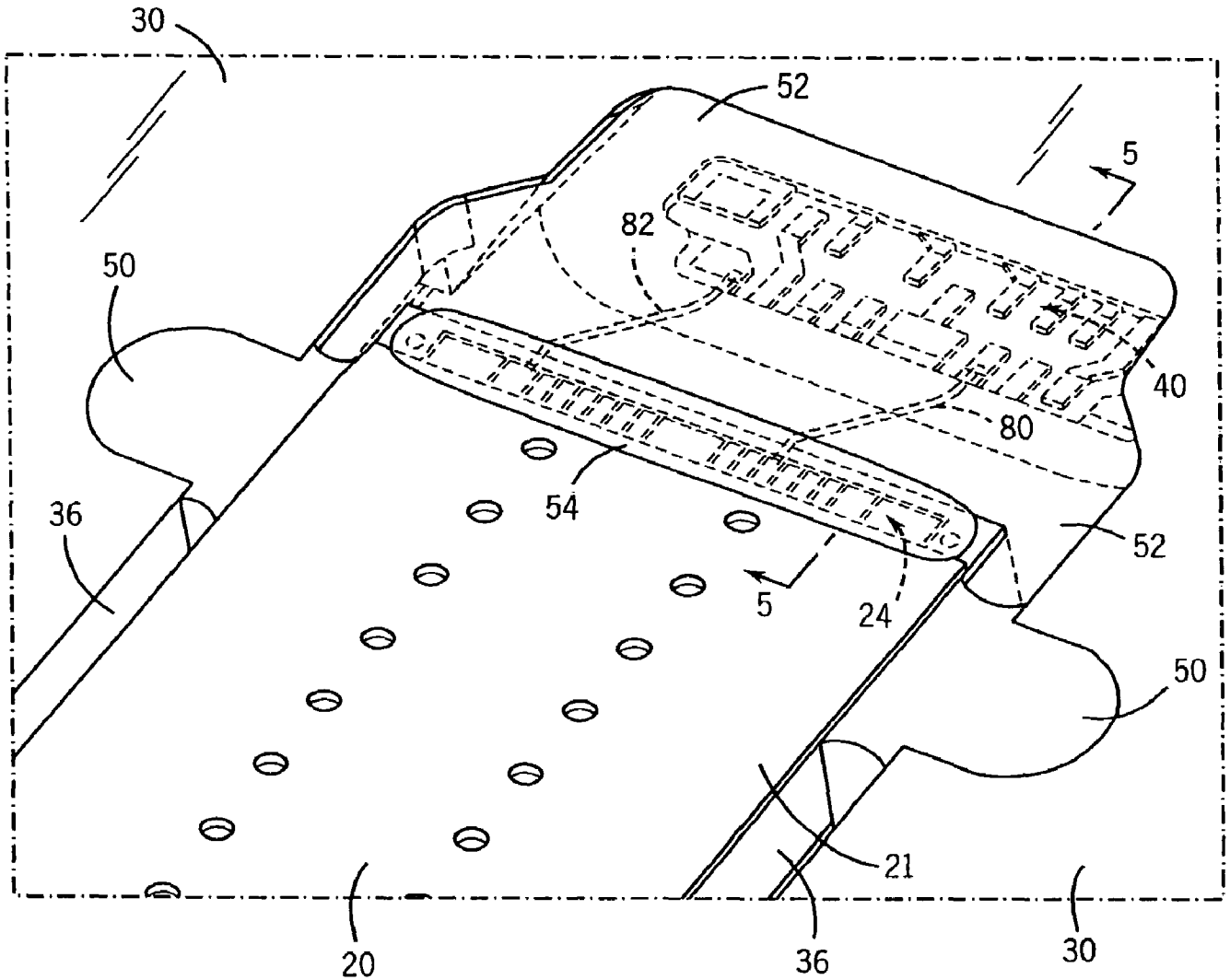
FIG. 4 is a perspective view of the portion of the fluid ejection device shown as an example embodiment in FIG. 3 showing an adhesive material disposed upon portions of the printhead, wires, and electrical contacts.

As shown in FIG. 3, apertures 32 have a size and shape such that contacts 40 provided on substratum 60 are also provided within apertures 32 when cover 30 is coupled to substratum 60. Thus, each aperture 32 provided in cover 30 includes both at least one printhead 20 and a plurality of contacts 40. As shown in FIG. 3, printheads 20 include electrical contacts 24 provided on a top surface 21 of printheads 20. Such electrical contacts may be coupled to contacts 40 by a connector (see, e.g., FIG. 4, showing example wires 80 and 82). In this manner, electrical communication between printheads 20 and fluid ejection device 10 may be achieved. According to another example embodiment, another type of connector may be utilized in place of wires 80, 82 (e.g., a connector having a single wire with a plurality of contacts, etc.).

It should be noted that while FIG. 4 shows only two wires 80, 82 coupled between contacts provided on printhead 20 and substratum 60, more than two wires may be provided according to other embodiments. Wires 80, 82 are intended only to show the connection between contacts 24 and contacts 40. For example, according to other example embodiments, between approximately 20 and 30 wires (e.g., 25 wires) are provided to connect contacts 24 to contacts 40. Any number of wires may be provided to connect contacts 24 to contacts 40 according to various other embodiments.

It should also be noted that while a particular configuration, number, and arrangement is shown for contacts 24 and contacts 40, any of a variety of other configurations, numbers, or arrangements may be used according to other embodiments. According to an example embodiment, each printhead 20 includes contacts 24 at opposite ends of printhead 20, and contacts 40 are provided within aperture 40 at each of the opposite ends of printhead 20. That is, each printhead is configured to be connected by wires to contacts provided on the substratum at two ends of the printhead. According to another example embodiment, contacts are provided on the top surface only at one location on the top surface of the printhead, such that only one set of wires is utilized to connect such contacts to contacts provided on the substratum.

According to an example embodiment, substratum 60 comprises a ceramic material. For example, according to an example embodiment shown in FIG. 5, substratum 60 comprises multiple ceramic layers 62, 64, 66, 68, and 70. Any of a variety of materials may be used to form layers 62 through 70. For example, layers 62, 64, 66, 68, and 70 may be a multilayer printed circuit board (PCB), a multilayer Flex circuit, a Tape Automated Bonding (TAB) circuit, or any other type of structure for routing conductive traces on a substratum, with or without an attached ceramic or plastic stiffener.

As described above with respect to FIG. 3, a gap 36 is provided between a side 28 of printhead 20 and a wall 33 of aperture 32. Gap 36 extends along the length of side 28 of printhead 20. According to an example embodiment, gap 36 has a width (e.g., between side 28 of printhead 20 and wall 33 of aperture 32) of approximately 0.015 inches (approximately 0.381 millimeters).

Figure 5:
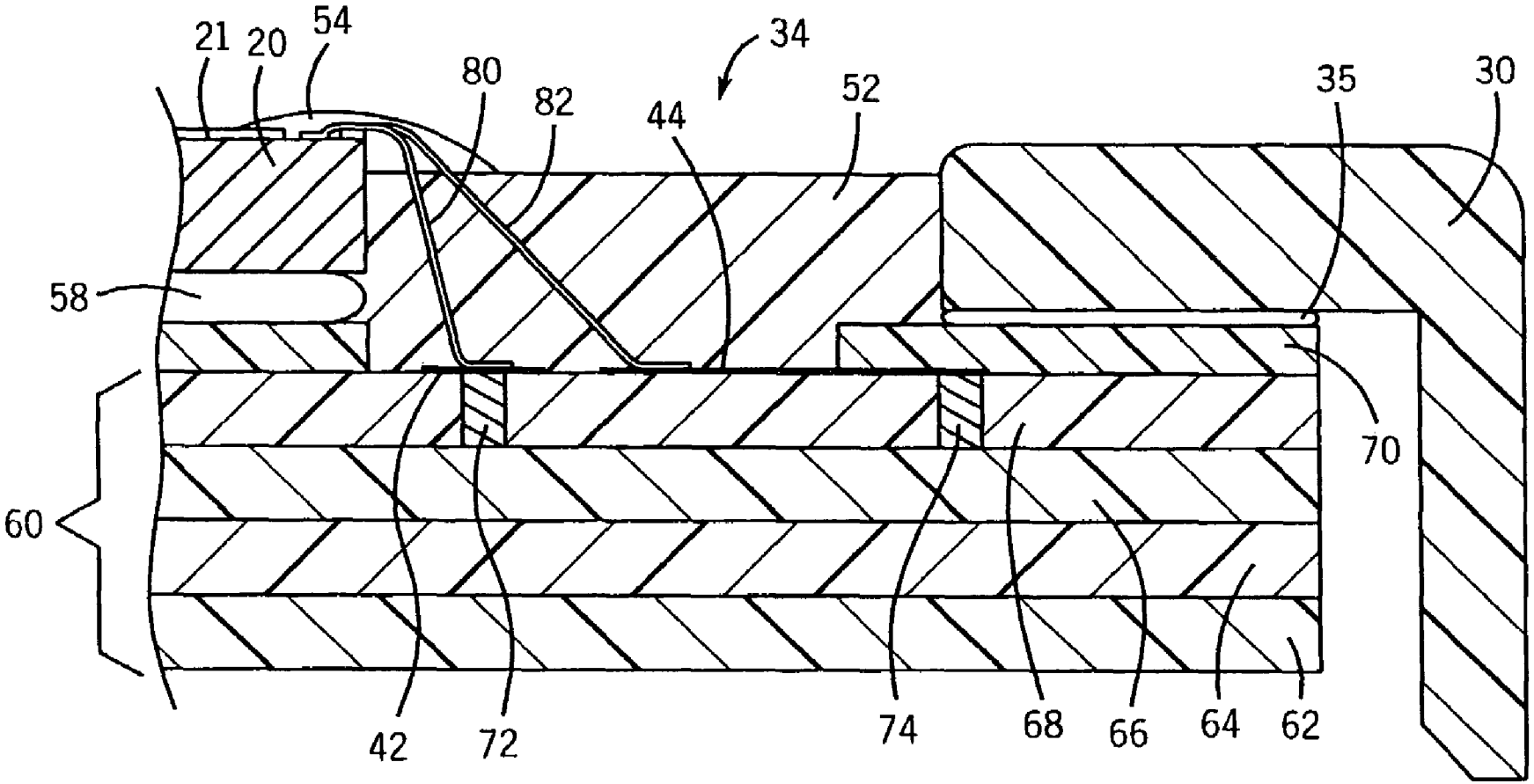
FIG. 5 is a side cutaway view of the portion of the fluid ejection device shown as an example embodiment in FIG. 4 viewed across line 5-5.

A gap 34 in the form of a trench or moat is also provided adjacent end 26 of printhead 20. Contacts 40 provided on substratum 60 are provided in gap 34. As shown generally in FIGS. 4 and 5, wires 80, 82 connect contacts 24 provided on a top surface 21 of printhead 20 to contacts 40 provided on substratum 60 in gap 34. As shown in FIG. 5, a top surface of cover 30 is substantially coplanar with top surface 21 of printhead 20, and wires 80, 82 may, but need not, extend slightly above the plane of top surface 21 of printhead 20.

To protect wires 80, 82 and contacts 24, 40 from damage (e.g., corrosion fracture, breakage, bending, etc.), a material such as an adhesive is used to protect wires 80, 82 and contacts 24, 40. According to an example embodiment, an epoxy is used to cover or coat wires 80, 82 and contacts 24, 40. According to other example embodiments, other materials may be used to protect wires 80, 82 and contacts 24, 40 from damage. Exemplary, but non-limiting materials, include, silicone, ultraviolet adhesives, overmolded plastics, pressure sensitive adhesive (PSA) tape, underfill adhesives, etc. According to another exemplary embodiment, the adhesive utilized may vary for the individual contacts and wires, and may be selected based on the material utilized to form the wires and contacts.

As shown in FIGS. 4 and 5, a material in the form of an adhesive 52 (e.g., an epoxy) is provided in gap 34 to cover or coat contacts 40 and a portion of wires 80, 82. Such an operation may be referred to as an "end fill," as the end of aperture 32 (near end 26 of printhead 20) is at least partially filled with adhesive material. According to other example embodiments, adhesive 52 may extend above the plane formed by top surface 21 and the top surface of cover 30. It should also be noted that while adhesive 52 is shown as having a relatively planar upper surface, according to other example embodiments, such adhesive may exhibit a curvature (e.g., meniscus) on the upper surface.

After adhesive 52 is provided in gap 34, another adhesive such as adhesive 54 is provided to cover or coat contacts 24 and a portion of wires 80, 82 not covered by adhesive 52. As shown in FIGS. 4 and 5, adhesive 54 is provided such that it extends along a substantial portion of the width of printhead 20 and beyond end 26 of printhead 20. As shown in FIG. 5, adhesive 54 is provided such that it has a generally curved shape. One advantageous feature of providing adhesive 54 to cover the top portion of wires 80, 82 is that damage to wires 80, 82 during cleaning operations are minimized (e.g., a cleaning mechanism is brushed across top surface 21 of printhead 20 during cleaning, which may damage wires 80, 82 if such wires were not coated with a relatively hard or strong adhesive such as adhesive 54). According to an example embodiment, the top of adhesive 54 extends between approximately 0.003 and 0.006 inches (between approximately 0.0762 and 0.1524 millimeters) above top surface 21 of printhead 20.

Wires 80, 82 may be relatively fragile, e.g., subject to breakage. For example, according to an example embodiment, wires 80, 82 have a diameter of approximately 0.001 inches (0.0254 millimeters). Wires 80, 82 may be made of any suitable conductive metal, including but not limited to copper, aluminum, gold, gold plated copper, and the like.

To prevent damage to wires 80, 82 during provision of adhesive 52 (e.g., when adhesive 52 is provided in gap 34), an epoxy material is used for adhesive 52 that has a relatively low viscosity. According to an example embodiment, adhesive 52 is a thermally cured epoxy and has a viscosity of between approximately 10,000 and 30,000 centipoise (cP). According to other example embodiments, the viscosity of adhesive 52 is between approximately 100 and 1,000,000 cP. One advantageous feature of providing adhesive 52 with a relatively low viscosity is that damage and stress to wires 80, 82 is reduced, since adhesive 52 may flow freely around wires 80, 82 without damaging them. Another advantageous feature is that such an epoxy may be used to provide a relatively consistent base for an encapsulation adhesive (e.g., adhesive 54) to enable the provision of a bead of adhesive 54 having a relatively low profile.

It is desirable to maintain adhesive 52 in gap 34 without allowing it to flow along sides 28 of printhead 20. Due to the relatively low viscosity of adhesive 52 (which is desirable to allow it to flow between wires 80, 82), there may be a tendency for adhesive 52 to flow to locations away from wires 80, 82 and contacts 40 (e.g., by flowing or wicking along sides 28 of printhead 20). One reason that it is desirable to prevent adhesive 52 from flowing along sides 28 of printhead 20 is that printhead 20 may be relatively fragile. For example, according to an example embodiment, printhead 20 comprises a silicon or silicon-containing material and has a thickness of approximately 0.027 inches (approximately 0.675 millimeters). According to other example embodiments, the thickness of printhead 20 may be between approximately 0.015 and 0.040 inches (between approximately 0.381 and 1.0 millimeters).

Because printhead 20 is relatively fragile, printhead 20 may become damaged (e.g., fractured, etc.) during usage of fluid ejection device 10. One reason for such damage is that the thermal expansion coefficient of adhesive 52 differs from that of the silicon or silicon-containing material used to form printhead 20. When adhesive 52 is heated (e.g., to operating temperatures between approximately 50° C. and 90° C.), adhesive 52 may expand to a greater degree than the material used to form printhead 20, thus introducing compressive stresses to printhead 20 that may cause fracture or breakage of printhead 20. In another example, the printhead may expand more than the adhesive, which may result in tensile stresses in the printhead, which also may result in damage to the printhead. According to an example embodiment, to sufficiently reduce the occurrence of damage to printhead 20 due to thermal expansion differences between printhead 20 and adhesive 52, adhesive 52 should flow no more than 0.08 inches (2.03 mm) along side 28 of printhead 20. According to other example embodiments, an adhesive may be provided such that it flows a greater distance along the side of the printhead.

To reduce the occurrence of damage to printhead 20, it is therefore desirable to prevent flow of adhesive 52 along sides 28 of printhead 20 (i.e., to restrict the flow of adhesive 52 to areas of gap 34 that is adjacent contacts 40 and wires 80, 82). According to an example embodiment, a feature such as a barrier or dam 50 is provided to prevent the flow of adhesive 52 along sides 28 of printhead 20 (see, e.g., FIGS. 3 and 4).

Cover 30 includes cutouts or apertures 38 (e.g., reliefs) that extend outward from aperture 32 into cover 30. According to an example embodiment, cutouts 38 have a generally rounded or semi-circular shape. According to other example embodiments, other shapes for cutouts 38 may be utilized (e.g., square, rectangular, etc.). As shown in FIGS. 3 and 4, barrier 50 is provided in cutout 38 and in a portion of gap 36 adjacent side 28 of printhead 20. Because barrier 50 effectively blocks gap 36, adhesive 52 is unable to flow past barrier 50 along sides 28 of printhead 20.

According to an example embodiment, barrier 50 comprises a material such as an adhesive or epoxy 56. The material used to form barrier 50 has a viscosity that is higher than that used to fill gap 34 (e.g., adhesive 52). In this manner, the material used to form barrier 50 is relatively thicker or more viscous as compared to adhesive 52. One advantageous feature of utilizing a relatively viscous material for barrier 50 is that the material used to form barrier 50 will remain within cutout 38 and in an area adjacent printhead 20 without flowing along sides 28 of printhead 20. Thus, while barriers 50 are in contact with a portion of sides 28 of printhead 20, they extend only a relatively small distance along sides 28 (e.g., between approximately 0.5 and 1.5 mm) and are provided near the ends of printhead 20 that are adjacent to contacts 40, in order to prevent substantial flow of adhesive 52 along sides 28 of printhead 20.

According to an example embodiment, adhesive 56 used to form barriers 50 is a thermally cured or ultraviolet (UV) cured epoxy having a viscosity of between approximately 30,000 and 50,000 cP. In general, the viscosity of adhesive 56 should be greater than adhesive 52 and less than adhesive 54.

After barrier 50 is provided in cutout 38 and adhesive 52 is used to substantially fill gap 34 (i.e., to cover contacts 40 and a portion of wires 80, 82), another material such as an adhesive material 54 such as an epoxy is provided above or over contacts 24 (provided on top surface 21 of printhead 20) and the remaining uncovered portion of wires 80, 82. Adhesive 54 is referred to as an encapsulation or encap material.

According to an example embodiment, adhesive 54 has a higher viscosity than both adhesive 52 and the material used to form barrier 50. One advantageous feature of using a relatively viscous material for adhesive 54 is that adhesive 54 will remain in place above or over contacts 24 and a top portion of wires 80, 82 without flowing away from wires 80, 82 and contacts 24. Another advantageous feature of providing a relatively viscous material for adhesive 54 is that such a material is more likely to withstand stresses or damage that may result from use of fluid ejection device (e.g., during the cleaning operation used for fluid ejection device 10).

According to an example embodiment, adhesive 54 is a thermally cured or UV cured epoxy having a viscosity of between approximately 40,000 and 100,000 cP. In general, the viscosity of adhesive 54 should be thick enough to provide adequate protection of the conductive traces and/or wires utilized to electrically couple the printhead to the substratum.

One advantageous feature of using adhesives for adhesives 52, 54, and 56 that have similar chemistries is that relatively good bonding may be obtained between the adjacent adhesives. In this manner, mismatch between the adhesives may be reduced.

Adhesives 52, 54, and 56 are relatively resistant to ink according to an example embodiment. For example, adhesives 52, 54, and 56 are relatively resistant to absorption of ink used by fluid ejection device 10 according to an example embodiment. One disadvantage of using adhesives that absorb ink is that such adhesives may expand due to the absorption, which may introduce stresses that may damage printhead 20 (e.g., expansion of adhesive 52 may introduce compressive stresses in printhead 20, which may result in cracking or other damage to printhead 20).

While particular examples of adhesives have been described with respect to adhesives 52, 54, and 56, according to other example embodiments, adhesives 52, 54, and 56 may comprise other materials, such as silicone, UV adhesives, overmolded plastics, pressure sensitive adhesive (PSA) tape, underfill adhesives, etc.

Figure 6:
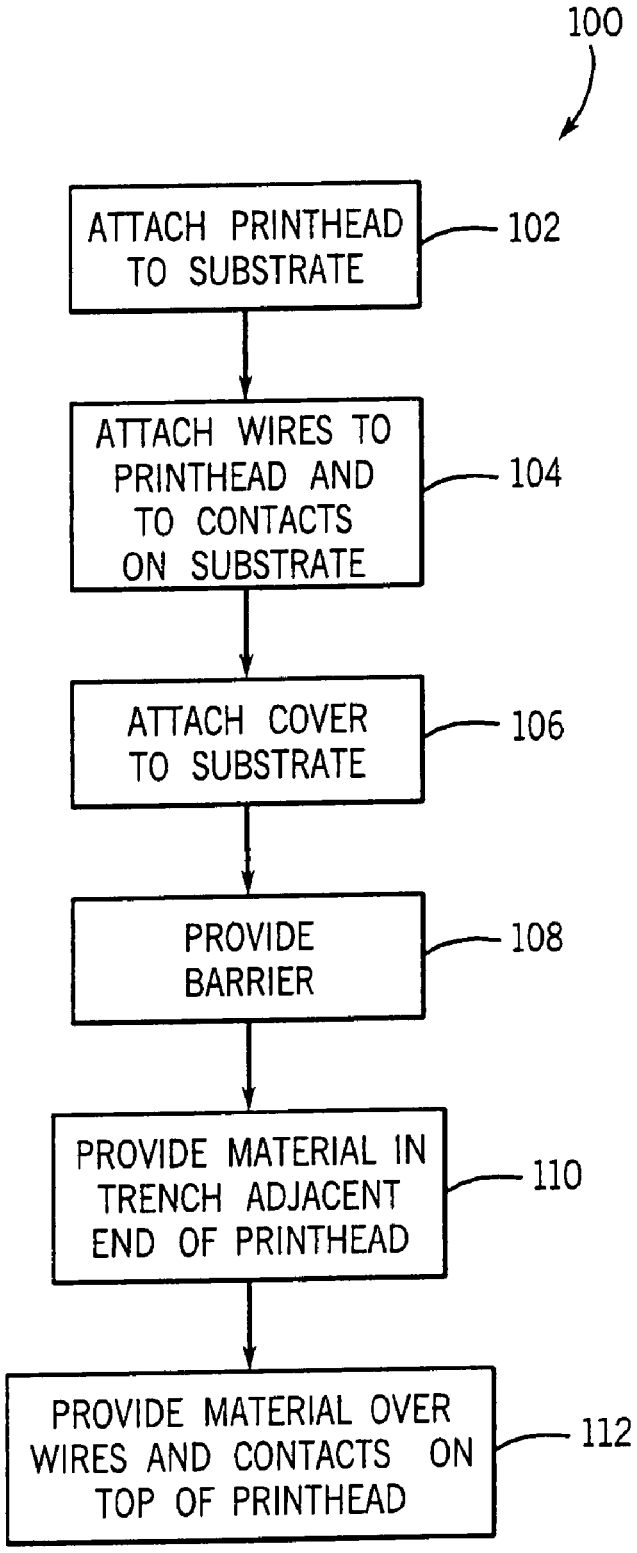
FIG. 6 is a flow diagram describing steps of manufacturing a fluid ejection device according to an example embodiment.

FIG. 6 is a flow diagram 100 illustrating selected steps in a method of manufacture of fluid ejection device 10. In a step 102, printhead 20 is coupled to substratum 60 at locations intermediate contacts 40. According to an example embodiment, printhead 20 is coupled to substratum 60 with an adhesive or epoxy 58 (see, e.g., FIG. 5). For example, adhesive 58 may comprise a thermally cured epoxy or thermally cured underfill adhesive. Adhesive 58 is provided in a manner such that adhesive 58 extends beneath substantially the entirety of printhead 20. In this manner, other adhesives used during the manufacturing process of fluid ejection device 10 (e.g., adhesive 52) and/or inks used with fluid ejection device 10 are substantially prevented from flowing or encroaching beneath printhead 20. According to an example embodiment, adhesive 58 is provided to a thickness of between approximately 0.010 and 0.020 inches (between approximately 0.25 and 0.50 millimeters).

In a step 104, wires 80, 82 (and additional wires according to other example embodiments) are coupled between printhead 20 (i.e., contacts 24 provided on top surface 21 of printhead 20) and contacts 40 provided on substratum 60. It should be noted that while contacts 40 have been referred to herein as being contacts (e.g., such as contact 42 shown in FIG. 5), some of contacts 40 may be conductive lines or traces 44 (see, e.g., FIG. 5) may also be provided on substratum 60 that provide an electrical connection between wires 80, 82 and conductive vias 72, 74 provided in substratum 60.

Cover 30 is attached to substratum 60 in a step 106. According to an example embodiment, a pressure sensitive adhesive (PSA) 35 is utilized to attach cover 30 to substratum 60. According to an example embodiment, pressure sensitive adhesive 35 is a an acrylic adhesive with a tissue carrier. Pressure sensitive adhesive 35 may be provided in a sheet having apertures provided therein (e.g., laser cut apertures) that have a size and shape similar to that of aperture 32 provided in cover 30. In this manner, the aperture formed in pressure sensitive adhesive 35 has a similar size and shape as aperture 32 provided in cover 30. Cover 30 is attached to substratum 60 by first attaching pressure sensitive adhesive 35 to cover 30 (e.g., aligning the apertures formed in the adhesive with apertures 32 provided in cover 30). After pressure sensitive adhesive 35 is secured to cover 30, cover 30 is attached to substratum 60 by applying pressure to the cover and substratum.

According to other example embodiments, other adhesive or adhesives may be used in place of pressure sensitive adhesive 35. For example, instead of using a pressure sensitive adhesive, epoxy film adhesive, needle dispensed adhesive or paste, direct thermal stake, and/or mechanical methods such as screws, rivets, snaps, swaging, etc. may be used to secure cover 30 to substratum 60.

One or more barriers 50 are provided in a step 108 in one or more cutouts 38 formed in cover 30 and adjacent to a portion of printhead 20. Barriers 50 acts to prevent adhesive or epoxy subsequently deposited in gap 34 from flowing or wicking along sides 28 of printhead 20. According to an example embodiment, an automated needle-type dispenser is utilized to provide or deposit adhesive in the proper location, the desired size, and the desired shape to form barrier 50.

In a step 110, a material such as an adhesive or epoxy 52 is provided in gap 34 adjacent end 26 of printhead 20. Adhesive 52 flows throughout gap 34 to cover contacts 40 and a portion of wires 80, 82. Adhesive 52 is prevented from flowing or wicking along sides 28 of printhead 20 by barriers 50. That is, barriers 50 act to restrict the flow of adhesive 52 along sides 28 of printhead 20 away from wires 80, 82 and contacts 40.

In a step 112, a material such as adhesive or epoxy 54 is provided above or over contacts 24 provided on printhead 20 and around the portion of wires 80, 82 not covered by adhesive 52. Wires 80, 82 are completely encapsulated or covered by the combination of adhesives 52 and 54.

According to an example embodiment, adhesive 56 used to form barriers 50 is co-cured in an oven with adhesive 52 at temperatures greater than approximately 90° C. for a period greater than approximately one hour. Adhesive 54 is sequentially cured in an oven or furnace at a similar cure profile. According to another example embodiment, each of the adhesives may be cured separately in a sequential curing process. The curing times and temperatures utilized for each of the adhesives may vary according to any of a variety of factors, including the composition of the adhesives, the humidity, the altitude, the amount of the adhesive to be cured, the size and shape of the adhesive to be cured, and any of a variety of other factors.

It is intended that the use of barrier 50 allows the use of adhesives (e.g., adhesive 52) that may provide relatively robust protection for wires 80, 82 while not damaging the wires or printhead 20. By preventing flow of adhesive to locations adjacent the sides of printhead 20, the occurrence of thermally-induced cracking of printhead 20 is reduced. It is also intended that the use of such a configuration enables the use of industry-standard adhesive formulations (e.g., adhesives that are resistant to ink) and reduces the complexity of the dispense and cure process and tooling.

Figure 7:
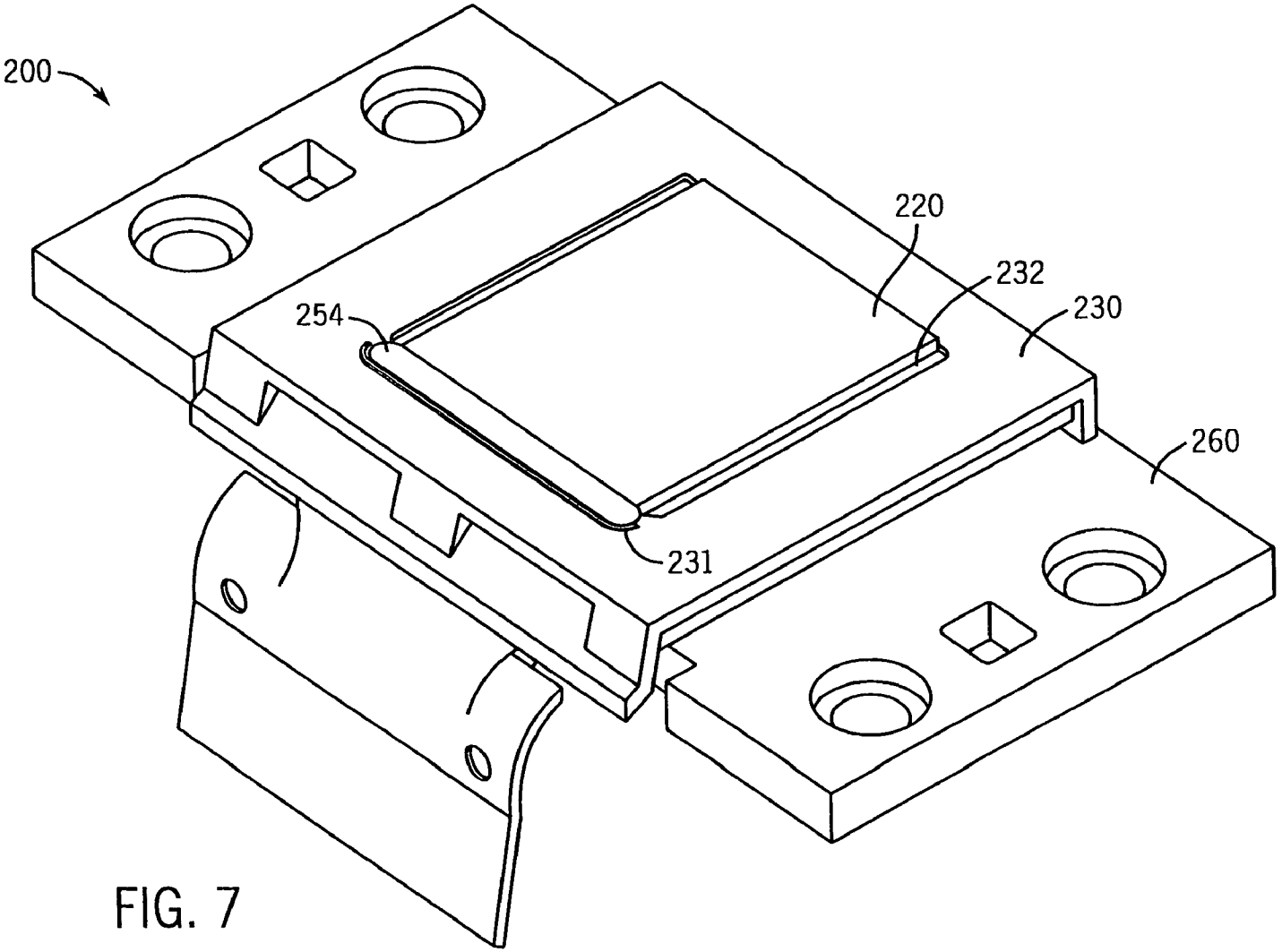
FIG. 7 is a perspective view of a fluid ejection device according to another example embodiment.

FIG. 7 shows a fluid ejection device 200 according to another example embodiment in which a printhead 220 is attached or coupled to a substratum 260. A cover or shroud (e.g., a capping shroud) having an aperture 232 provided therein is also coupled to substratum 260 such that printhead 220 is provided in aperture 232. Aperture 232 has a size and shape such that a gap exists between printhead 220 and cover 230.

Similar to the arrangement described with respect to FIGS. 1-6, connectors such as wires or tab beams (not shown) are used to electrically connect contacts on printhead 220 to contacts or pads provided on substratum 260. Such wires are encapsulated using a material such as an adhesive or epoxy 254. Adhesive 254 may be any suitable adhesive, such as an epoxy similar to that described above with respect to adhesives 52, 54, and 56. According to an example embodiment, adhesive 254 is a thermally cured or UV cured epoxy having a viscosity of between approximately 800 and 6000 poise. According to an example embodiment, adhesive 254 is resistant to ink penetration and resistant to wear caused by relatively frequent printhead cleaning.

According to an example embodiment, a single adhesive is utilized to cover the wires and contacts. According to another example embodiment, a number of adhesives may be utilized (e.g., similar to that described with reference to FIGS. 1-5, in which an adhesive is utilized to form a barrier is utilized in addition to two adhesives configured to cover or coat the various wires and contacts). In a situation where a single adhesive is utilized, the adhesive may have a viscosity sufficient to prevent flow or wicking of the adhesive along the sides of printhead 220 (e.g., to reduce the likelihood that printhead 220 may become damaged due to expansion of the adhesive).

It may be desirable to prevent adhesive 254 from encroaching onto cover 230. When adhesive 254 is provided in aperture 232 (e.g., utilizing a dispense nozzle for an adhesive in the form of a liquid or paste), the adhesive may have a tendency to flow outward from the printhead and onto at least a portion of the cover. One disadvantage of such a situation is that manufacturing costs may be incurred due to an increased number of scrapped parts.

Figure 8:
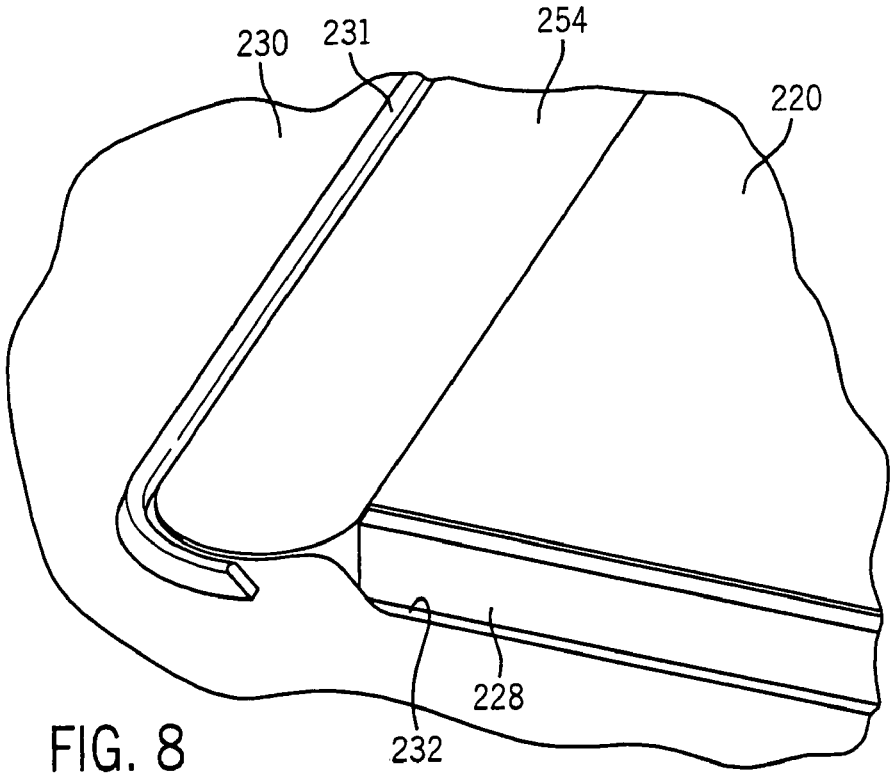
FIG. 8 is a perspective view of a portion of the fluid ejection device shown as an example embodiment in FIG. 7.

One mechanism by which flow of adhesive 254 away from aperture 232 onto cover 230 may be prevented is the provision of a barrier 231 such as a protrusion or extension on cover 230. As shown in FIG. 8, a feature such as a barrier 231 extends above a top surface of cover 230 to provide a barrier to prevent the flow of adhesive 254 over the surface of cover 230 beyond barrier 231, thus retaining adhesive 254 in the location adjacent the wires and contacts. Such a barrier may be molded (e.g., integrally molded) with cover 230 according to an example embodiment.

According to another example embodiment, the barrier may be formed separately and attached or coupled to the cover (e.g., using an adhesive, etc.). According to another example embodiment, the barrier may be machined into the cover. According to another example embodiment, the barrier may be formed on the printhead using photolithography (e.g., by patterning and etching, etc.) of the thin film layers of the substratum to form either a protrusion or a trench (e.g., a trough). In this example, the barrier is intended to act to prevent adhesive (e.g., adhesive 254) from flowing onto the printhead where it would interfere with printhead cleaning or would plug ink nozzles. In an example where a trench or trough is provided in either the cover or the printhead to prevent adhesive from flowing past the trench or trough, the trench may have a depth of approximately 0.001 inches (0.0254 mm). According to other example embodiments, the trench may have a different depth (e.g., greater or less than 0.001 inches).

Figure 9:
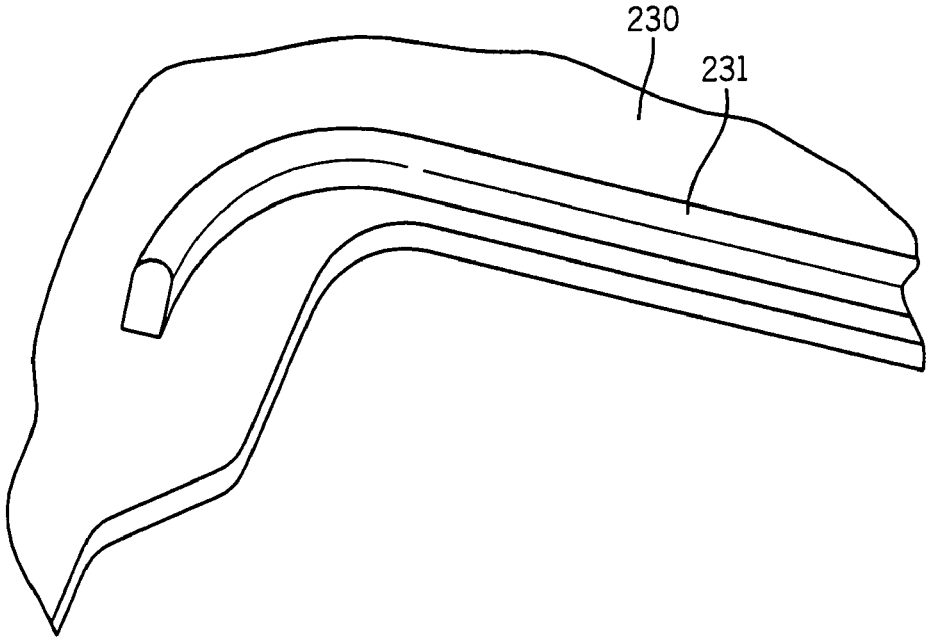
FIG. 9 is a perspective view of a portion of a cover such as that shown as an example embodiment in conjunction with the fluid ejection device shown in FIG. 7.

As shown in FIGS. 7-9, barrier 231 extends along one side of aperture 232 and has curved or rounded portions at either end of barrier 231. Barrier 231 also has a relatively rounded shape (e.g., barrier 231 has a relatively convex shape relative to the surface of cover 230). According to various other example embodiments, the barrier may have any of a variety of shapes, sizes, and configurations. For example, the barrier may have a relatively square cross-section. In another example, the barrier may extend around the entire aperture formed in the cover.

According to an example embodiment, barrier 231 extends above the top surface of cover 230 by between approximately 100 and 200 microns. Thus, barrier 231 is provided such that it extends above the surface of cover 230 to a lesser degree than permitted for adhesive 254 (which may extend, e.g., between approximately 200 and 350 microns above the surface of cover 230). According to other example embodiments, the barrier extends above the top surface of the cover by between approximately 50 and 200 microns.

Use of barrier 231 advantageously allows for relatively accurate provision of encapsulant material (i.e., adhesive 254) while preventing flow of such material over the top surface of cover 230 without the need to use a precision dispense system (e.g., a vision system, etc.). It is also intended that barrier 231 allows the use of various encapsulant materials (e.g., adhesives, etc.) having a relatively wide range of flow properties while maintaining the accuracy of the location of the material. It is intended that the use of barrier 231 allows for relatively small dimension and space requirements of fluid ejection device 200 to be achieved while reducing the amount of scrapped parts obtained during manufacturing.

The one or more connectors (e.g., wires 80, 82 or tab beams) utilized to connect the contacts provided on the substratum to those provided on the printhead may be completely or partially covered by one or more encapsulants (e.g., adhesives 52 and 54). According to an example embodiment in which the connectors are completely covered, the encapsulant materials utilized (e.g., adhesives 52 and 54) must be compatible with each other. According to an example embodiment in which the one or more connectors are partially covered, one or more encapsulant materials may be utilized. For example, in the case of a flexible circuit (e.g., as may be utilized in conjunction with the embodiment shown in FIG. 7) that includes protruding wires or beams, it may be necessary only to use a single encapsulant. According to another example embodiment in which wires extend from the top surface of the printhead to contacts provided in the substratum (see, e.g., FIG. 5), then two compatible adhesives may be used to encapsulate the wires.

It is important to note that the construction and arrangement of the fluid ejection device and the steps of the various methods described and shown in the various example embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to other embodiments. Other substitutions, modifications, changes and omissions may be made in the design, operating conditions and arrangement of the example embodiments without departing from the scope of the present inventions as expressed in the appended claims.

What is claimed is:

1. A cover for a fluid ejection device for an ink jet printer comprising:

at least one aperture configured to receive at least a portion of a printhead therein when the cover is coupled to the fluid ejection device; and a barrier protruding from a surface of the cover adjacent at least a portion of the aperture; and wherein the barrier is configured to restrict the flow of an adhesive over the surface of the cover beyond the barrier, wherein the adhesive is utilized to encapsulate at least one connector used to electrically connect the printhead to the fluid ejection device.

2. The cover of claim 1, wherein the barrier is integrally formed with the cover.

3. The cover of claim 1, wherein at least a portion of the barrier has a relatively rounded cross-sectional shape.

4. The cover of claim 1, wherein the aperture has at least one side and the barrier extends along the entire side of the aperture.

5. The cover of claim 1, wherein the cover has a size and a shape such that a gap is provided between the cover and the printhead when the cover is coupled to the fluid ejection device.

6. The cover of claim 1, wherein the cover further comprises at least one cutout formed in the cover extending outward from the aperture for receiving therein at least a portion of a barrier material.

7. A cover for a fluid ejection device for an ink jet printer comprising:

at least one aperture configured to receive at least a portion of a printhead therein when the cover is coupled to the fluid ejection device, the printhead including a nozzle surface and having a perimeter defined by opposite ends and opposite sides extended between the opposite ends, the opposite ends and the opposite sides oriented substantially perpendicular to the nozzle surface; and at least one cutout formed in the cover extending outward from the aperture for receiving therein at least a portion of a barrier material;

wherein the barrier material contacts and extends between the cover and at least one of the sides of the printhead, and is configured to restrict the flow of an adhesive along the at least one of the sides of the printhead, wherein the adhesive is utilized to encapsulate at least one connector used to electrically connect the printhead to the fluid ejection device.

8. The cover of claim 7, wherein at least a portion of the at least one cutout has a relatively rounded shape.

9. The cover of claim 7, wherein the cover comprises at least two cutouts formed in the cover extending outward from the aperture.

10. The cover of claim 9, wherein each of the cutouts are configured to receive at least a portion of a barrier that is configured to prevent the flow of the adhesive along the length of the printhead when the cover and the printhead are coupled to the fluid ejection device.

11. The cover of claim 7, wherein the cover has a size and a shape such that a gap is provided between the cover and the printhead when the cover is coupled to the fluid ejection device.

12. The cover of claim 7, wherein the cover further comprises a barrier protruding from a surface of the cover adjacent at least a portion of the aperture.

* * * * *